US010649354B2

(12) United States Patent
Fukaya

(10) Patent No.: US 10,649,354 B2
(45) Date of Patent: May 12, 2020

(54) ELECTROPHOTOGRAPHIC PHOTORECEPTOR AND IMAGE FORMING APPARATUS

(71) Applicant: KYOCERA Corporation, Kyoto-shi, Kyoto (JP)

(72) Inventor: Tomomi Fukaya, Hikone (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/466,442

(22) PCT Filed: Dec. 27, 2017

(86) PCT No.: PCT/JP2017/047113
§ 371 (c)(1),
(2) Date: Jun. 4, 2019

(87) PCT Pub. No.: WO2018/124243
PCT Pub. Date: Jul. 5, 2018

(65) Prior Publication Data

US 2019/0310563 A1 Oct. 10, 2019

(30) Foreign Application Priority Data

Dec. 28, 2016 (JP) ..... 2016-257132

(51) Int. Cl.
*G03G 5/00* (2006.01)
*G03G 5/14* (2006.01)
(Continued)

(52) U.S. Cl.
CPC ..... *G03G 5/142* (2013.01); *G03G 5/08* (2013.01); *G03G 5/10* (2013.01); *G03G 5/147* (2013.01);
(Continued)

(58) Field of Classification Search
CPC ..... G03G 5/147; G03G 5/10; G03G 5/142
(Continued)

(56) References Cited

U.S. PATENT DOCUMENTS

2007/0231719 A1* 10/2007 Nishimura ..... G03G 5/04 430/56
2018/0275536 A1* 9/2018 Fukaya ..... G03G 5/0217

FOREIGN PATENT DOCUMENTS

JP 2007-293279 A 11/2007
JP 2011-197466 A 10/2011

* cited by examiner

*Primary Examiner* — Mark A Chapman
(74) *Attorney, Agent, or Firm* — Volpe and Koenig, P.C.

(57) ABSTRACT

The present disclosure relates to an electrophotographic photoreceptor which can suppress occurrence of abnormalities such as peeling or falling off of a film from a substrate end portion in a film formation step of a surface layer and maintain and reproduce a stable printing quality even in a use stage after productization, and an image forming apparatus including the same. An electrophotographic photoreceptor includes a cylindrical substrate including a chamfered face located between an substrate outer circumferential surface and a substrate end face, and a surface layer located on the outer circumferential surface. The substrate outer circumferential surface includes a first uneven portion. The chamfered face includes a second uneven portion and a third uneven portion located on a surface of the second uneven portion. A surface roughness Sa of the second uneven portion is larger than a surface roughness Sa of the third uneven portion.

19 Claims, 12 Drawing Sheets

(51) Int. Cl.

| | |
|---|---|
| ***G03G 5/147*** | (2006.01) |
| ***G03G 15/00*** | (2006.01) |
| ***G03G 5/10*** | (2006.01) |
| ***G03G 5/08*** | (2006.01) |

(52) U.S. Cl.
CPC ..... *G03G 5/14704* (2013.01); *G03G 5/14708* (2013.01); *G03G 15/75* (2013.01)

(58) Field of Classification Search
USPC ..... 430/60, 69
See application file for complete search history.

ELECTROPHOTOGRAPHIC PHOTORECEPTOR AND IMAGE FORMING APPARATUS

CROSS-REFERENCE TO RELATED APPLICATIONS

This application is a national stage entry according to 35 U.S.C. 371 of International Application No. PCT/JP2017/047113 filed on Dec. 27, 2017, which claims priority to Japanese Patent Application No. 2016-257132 filed on Dec. 28, 2016, the contents of which are entirely incorporated herein by reference.

TECHNICAL FIELD

The present disclosure relates to an electrophotographic photoreceptor and an image forming apparatus provided with the same.

BACKGROUND

An electrophotographic photoreceptor used in an image forming apparatus has a configuration in which a surface layer constituted by a charge injection blocking layer, a photoconductive layer, a surface protective layer, and the like is formed on an outer circumferential surface (outer surface) of a cylindrical substrate or the like. With regard to the electrophotographic photoreceptor, the applicant of the invention has proposed, in Japanese Unexamined Patent Publication JP-A 2007-293279 (Patent Literature 1), an electrophotographic photoreceptor capable of suppressing film peeling originated from an a surface layer end portion, which is generated at an end portion of the photoreceptor in use by setting a surface roughness Ra of a chamfered face provided between a substrate outer circumferential surface and a substrate end face of the cylindrical substrate (before the surface layer formation) to be larger than that of the substrate outer circumferential surface (0.01 μm≤Ra≤0.05 μm) and disposing a photosensitive layer (photoconductive layer) to cover a region ranging from the substrate outer circumferential surface to the chamfered face (refer to Japanese Unexamined Patent Publication JP-A 2007-293279 (Patent Literature 1)).

SUMMARY

The electrophotographic photoreceptor according to the present disclosure includes a cylindrical substrate including an outer circumferential surface, an end face, a chamfered face located between the outer circumferential surface and the end face, and a surface layer located on the outer circumferential surface. The outer circumferential surface includes a first uneven portion. The chamfered face includes a second uneven portion and a third uneven portion located on a surface of the second uneven portion. A surface roughness Sa of the second uneven portion is larger than a surface roughness Sa of the third uneven portion.

An image forming apparatus according to the present disclosure includes the electrophotographic photoreceptor mentioned above, and a peripheral member capable of contacting the electrophotographic photoreceptor.

DETAILED DESCRIPTION

Hereinafter, an electrophotographic photoreceptor according to an embodiment and an image forming apparatus provided with the same will be described with reference to the drawings. In addition, the following contents illustrate embodiments of the invention, and the invention is not limited to examples of the embodiments.

(Electrophotographic Photoreceptor)

An electrophotographic photoreceptor according to the embodiment will be described with reference to FIGS. 1A and 1B.

Figure 1A:
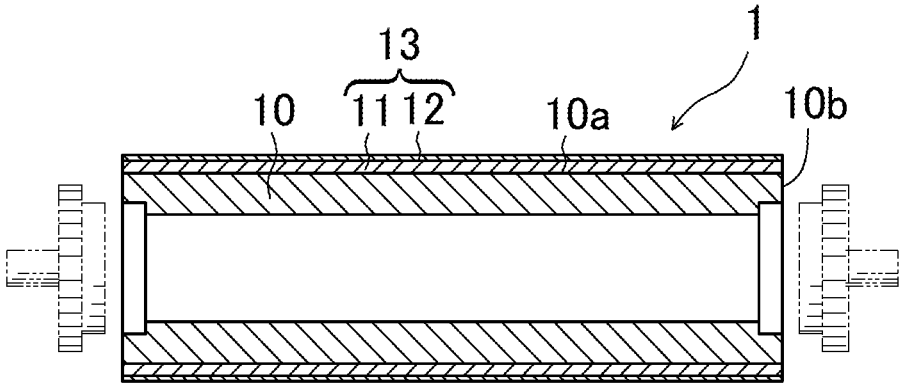
FIG. 1A is a cross-sectional view illustrating an electrophotographic photoreceptor according to an embodiment.
Figure 1B:
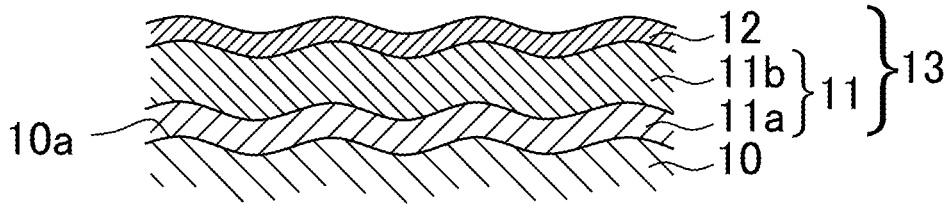
FIG. 1B is a cross-sectional view of a principal portion of FIG. 1A.

The electrophotographic photoreceptor 1 illustrated in FIGS. 1A and 1B includes a photosensitive layer 11 in which a charge injection blocking layer 11*a* and a photoconductive layer 11*b* are sequentially formed on the outer surface (substrate outer circumferential surface 10*a*) of a cylindrical substrate 10. A surface protective layer 12 is deposited on the outer circumferential surface of the photosensitive layer 11. In addition, herein, a surface layer 13 includes the photosensitive layer 11 and the surface protective layer 12.

The cylindrical substrate 10 serves as a support of the photosensitive layer 11, and at least the surface of the cylindrical substrate 10 has electrical conductivity.

The cylindrical substrate 10 is formed as a substrate of which the whole has electrical conductivity, for example, by using a metal material such as aluminum (Al), stainless steel (SUS), zinc (Zn), copper (Cu), iron (Fe), titanium (Ti), nickel (Ni), chromium (Cr), tantalum (Ta), tin (Sn), gold (Au), silver (Ag), magnesium (Mg), and manganese (Mn) or an alloy material containing the exemplified metal materials. In addition, the cylindrical substrate 10 may be a substrate formed by depositing a conductive film made of the exemplified metal material and a transparent conductive material such as indium tin oxide (ITO) or $SnO_2$ (tin dioxide) on the surface made of a resin, glass, or a ceramics. Among these exemplified materials, an aluminum (Al)-based material may be used as a material for forming the cylindrical substrate 10, and the entire cylindrical substrate may be formed by using the aluminum (Al)-based material. Then, the electrophotographic photoreceptor 1 can be manufactured at a light weight and at a low cost. Furthermore, in a case where the charge injection blocking layer 11*a* and the photoconductive layer 11*b* are formed by using an amorphous silicon (a-Si)-based material, the adhesion between the layers and the cylindrical substrate 10 becomes high, so that it is possible to improve the reliability.

The surface of the cylindrical substrate 10 may be roughened. The surface roughness of the cylindrical substrate 10 may be, for example, 50 nm<Sa<140 nm after surface roughening. In addition, as a method of surface roughening, for example, wet blast, sputter etching, gas etching, polishing, turning, wet etching, electric galvanic corrosion, or the like may be used. A drawn pipe that satisfies the above-mentioned surface roughness may be used as it is without performing surface treatment for adjusting the surface shape. In addition, in the invention, a portion (surface area) where the arithmetic mean height Sa of the surface is 25 nm or more is called a "rough surface".

In addition, the surface of the cylindrical substrate 10 may be surface-mirroring-processed before the above-mentioned surface roughening, but in such a case, it is preferable to perform oil removal after the surface mirroring processing before the surface roughening. Furthermore, the surface roughness of the cylindrical substrate 10 may be, for example, Sa<25 nm after the surface mirroring processing. In addition, in the invention, a portion (surface area) where the arithmetic mean height Sa of the surface is less than 25 nm is referred to as a "mirror surface".

In the present specification, Sa (arithmetic mean roughness) is one of the parameters representing a three-dimensional surface texture defined by ISO25178 and represents the arithmetic mean roughness (nm) of the absolute value of the height of the surface in a measurement target region from the average surface. In addition, the measurement of the surface shape with the three-dimensional roughness parameter based on ISO25178 was performed by a three-dimensional measurement laser microscope OLS4100 produced by Olympus Co., Ltd. described later. In addition, the measurement of the electrophotographic photoreceptor (surface layer) was performed on the product surface as it is, and the measurement of the outer surface (outer circumferential surface) of the cylindrical substrate under the surface layer was performed after removing the surface layer from the product of the electrophotographic photoreceptor by dry etching using $ClF_3$, $CF_4$, or the like.

In addition, the surface texture of the electrophotographic photoreceptor 1 needs not to satisfy a predetermined range over the entire surface of the surface protective layer 12. For example, in both end faces or the like in the axial direction of the cylindrical substrate 10 which does not contact a cleaning roller 116B or a cleaning blade 116A, the surface texture may have a value out of the range. This is the same for all the parameters of the surface texture described below.

The charge injection blocking layer 11*a* has a function of blocking injection of carriers (electrons) from the cylindrical substrate 10. The charge injection blocking layer 11*a* is made of, for example, an amorphous silicon (a-Si)-based material. The charge injection blocking layer 11*a* may be formed, for example, by using an amorphous silicon (a-Si) containing nitrogen (N) or oxygen (O) or both in the case of containing boron (B) as a dopant or by using an amorphous silicon (a-Si) containing nitrogen (N) or oxygen (O) or both in the case of containing phosphorus (P) as a dopant, and the thickness thereof is set to 2 μm or more and 10 μm or less.

The photoconductive layer 11*b* has a function of generating carriers by irradiation with light such as laser light. The photoconductive layer 11*b* is made of, for example, an amorphous silicon (a-Si)-based material and an amorphous selenium (a-Se)-based material such as Se—Te or $As_2Se_3$. The photoconductive layer 11*b* in the present example is made of amorphous silicon (a-Si) and an amorphous silicon (a-Si)-based material obtained by adding carbon (C), nitrogen (N), oxygen (O), and the like to amorphous silicon (a-Si) and contains boron (B) or phosphorus (P) as a dopant.

In addition, the thickness of the photoconductive layer 11*b* may be appropriately set in accordance with the photoconductive material to be used and the desired electrophotographic characteristics. In a case where the photoconductive layer 11*b* is formed by using an amorphous silicon (a-Si)-based material, the thickness of the photoconductive layer 11*b* may be set to, for example, 5 μm or more and 100 μm or less, and more specifically 10 μm or more and 80 μm or less.

The surface protective layer 12 has a function of protecting the surface of the photosensitive layer 11. The surface protective layer 12 may be formed by using an amorphous silicon (a-Si)-based material such as amorphous silicon carbide (a-SiC) or amorphous silicon nitride (a-SiN) or amorphous carbon (a-C) or may be formed to have a multi-layer structure thereof. In the present example, the surface protective layer 12 is formed to have a three-layer structure, and the third layer of the surface protective layer 12 which is the outermost surface after the film formation is formed by employing highly-resistant amorphous carbon (a-C) from the point of view of abrasion resistance against rubbing in the image forming apparatus.

The thickness of the surface protective layer 12 may be adjusted, for example, in accordance with the required durability of the electrophotographic photoreceptor, and does not have to be larger than necessary. For example, the thickness may be set to 0.1 μm or more and 2 μm or less, more specifically to 0.5 μm or more and 1.5 μm or less.

In the embodiment, the surface roughness of the surface protective layer 12 may be set to Str≥0.67, more specifically to Str≥0.79. Accordingly, it is possible to exhibit excellent durability characteristics and to suppress the occurrence of an image abnormality. That is, it is possible to suppress the frictional resistance with the cleaning roller, the cleaning blade, and the like in the initial stage, and it is possible to maintain the surface roughness within a certain range even when the surface is gradually abraded during durable use. As a result, since it is possible to continue to effectively suppress the increase in the frictional resistance between the surface protective layer and the cleaning roller or the cleaning blade, it is possible to suppress image abnormalities such as abnormal streaks in the printed image.

In addition, the surface roughness of the surface protective layer 12 may be set to Sal≤10.3 μm. Furthermore, the surface roughness of the surface protective layer 12 may be set to Sal≥0.9 μm, and more specifically, may be set to Sal≥1.6 μm. Accordingly, it is possible to more effectively exhibit the above-described excellent durability characteristics and the reduction in image abnormality. That is, due to the presence of the unevenness at a narrow pitch defined by the above-mentioned numerical values in the planar direction of the surface of the surface protective layer, it is possible to realize the reduction of the initial defect and the suppression of the increase in the frictional resistance during durable use.

In addition, in the present specification, Str (aspect ratio of surface texture) is one of the parameters representing the three-dimensional surface texture defined by ISO25178 and represents the aspect ratio of the surface texture. That is, Str is a scale that represents the uniformity of the surface texture, and the autocorrelation of the surface is defined by the ratio of the farthest lateral distance to the correlation value 0.2 to Sal. Str has a value in a range of 0 to 1. The larger the value, the stronger the isotropy, and the smaller the value, the stronger the anisotropy. In addition, in the present specification, Sal (shortest autocorrelation distance) is one of the parameters representing the three-dimensional surface texture defined by ISO25178, and represents the shortest autocorrelation distance (μm). Sal represents the closest lateral distance at which the surface autocorrelation attenuates to a correlation value of 0.2. That is, it represents the dominant minimum unevenness pitch in the lateral direction.

Herein, Sal and Str are values indicating the surface texture of the surface protective layer 12 of the electrophotographic photoreceptor 1 in the initial state, that is, the electrophotographic photoreceptor 1 before being repeatedly used many times in the image forming apparatus. This denotes that the values indicate the surface texture at the time of shipment from the factory for the electrophotographic photoreceptor 1 as a marketed product.

In addition, the surface protective layer 12 is excellent in transparency so as not to absorb or reflect light such as laser light with which the electrophotographic photoreceptor 1 is irradiated. In addition, the surface protective layer 12 may have a surface resistance value (generally $10^{11}$ Ω·cm or more) capable of retaining an electrostatic latent image in image formation.

Next, electrophotographic photoreceptors 1A to 1C (first to third embodiments) in which a chamfered face for reducing the edge angle is formed at a corner portion of the electrophotographic photoreceptor in the cylindrical axial direction, that is, between the substrate outer circumferential surface 10*a* and the substrate end face 10*b* of the electrophotographic photoreceptor 1 will be described. In addition, each figure illustrates the state after the surface layer 13 including the photosensitive layer 11 and the surface protective layer 12 is formed (stacked) on the surface of the substrate by using a plasma CVD apparatus (refer to FIG. 5) described later or the like.

Figure 2A:
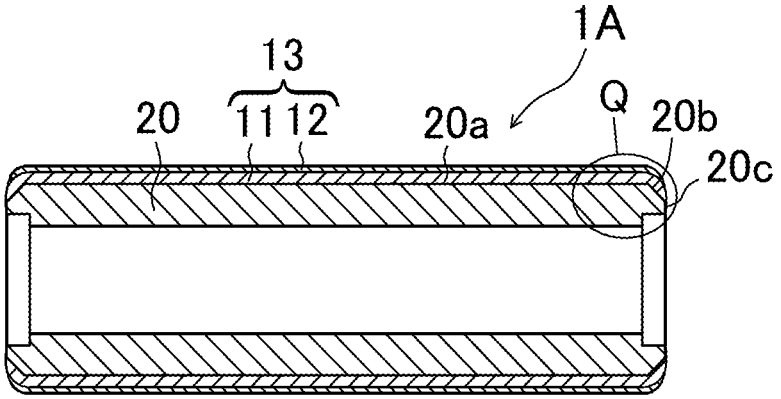
FIG. 2A is a cross-sectional view of an electrophotographic photoreceptor according to a first embodiment.
Figure 2B:
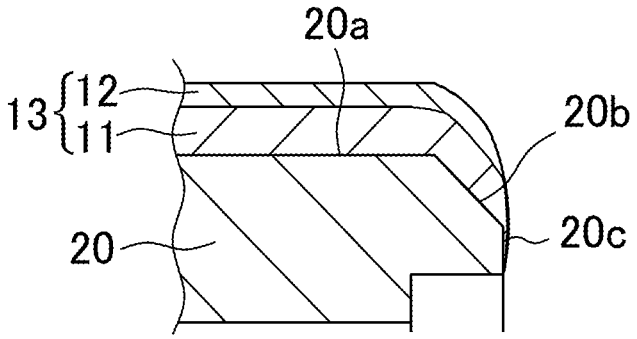
FIG. 2B is an enlarged cross-sectional view of a portion Q of FIG. 2A.
Figure 2C:
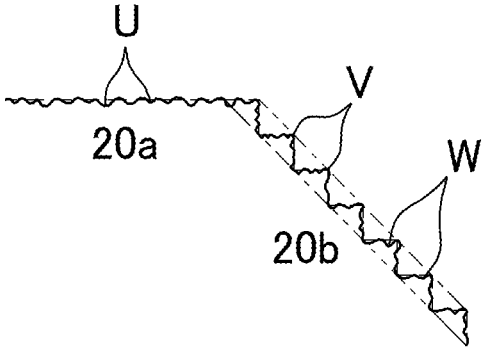
FIG. 2C is a schematic view illustrating an enlarged cross-sectional shape of the vicinity of the surface of a chamfered face of the electrophotographic photoreceptor.

FIG. 2A is a cross-sectional view of the electrophotographic photoreceptor 1A according to the first embodiment. FIG. 2B is an enlarged cross-sectional view of a portion Q in FIG. 2A. FIG. 2C is a schematic view illustrating an enlarged cross-sectional shape of the vicinity of the surface of a chamfered face 20*b* in a cylindrical substrate 20. In addition, since the thickness of each layer (film) (the same applies to FIGS. 3A to 3C, 4A, and 4B described below) is drawn so as to be emphasized in all the figures, the film thickness ratio and the unevenness ratio are different from the actual ones.

The cylindrical substrate 20 of the first embodiment illustrated in the figures has a substrate outer circumferential surface 20*a* having the shape and surface roughness similar to those of the cylindrical substrate 10 described in the above-described embodiment (FIG. 1A and FIG. 1B) and a substrate end face 20*c* at the end portion of the cylindrical axial direction similar to that of the cylindrical substrate 10, as well. The cylindrical substrate 20 is different from the cylindrical substrate 10 in that a chamfered face 20*b* having a shape of a slant face (C-face) is formed between the substrate outer circumferential surface 20*a* and the substrate end face 20*c* by chamfering processing using cutting or the like.

In addition, the cylindrical substrate 20 subjected to the chamfering processing is further subjected to the same surface roughening processing (for example, wet blast, polishing, or the like) as in the above-described embodiment. Then, when the outer surface of the cylindrical substrate 20 after the surface roughening processing is microscopically observed, a first uneven portion U with relatively small unevenness is formed on the surface of the substrate outer circumferential surface 20*a* by the surface mirroring processing and the surface roughening processing. In addition, it can be seen that a second uneven portion V with relatively large unevenness is formed on the surface of the chamfered face 20*b* by the chamfering processing and surface roughening processing and a third uneven portion W with small unevenness exists on the surface of the second uneven portion V (refer to FIG. 2C).

That is, it is estimated that the second uneven portion V with relatively large unevenness on the surface of the chamfered face 20*b* is a cutting mark or the like caused by the chamfering processing performed subsequent to the surface mirroring processing of the substrate outer circumferential surface 20*a*. The surface roughness (arithmetic mean height Sa) of the second uneven portion V reaches, for example, 180 to 1000 nm.

On the other hand, the surface roughness (arithmetic mean height Sa) of the third uneven portion W formed on the surface of the second uneven portion V is about 90 to 140 nm, and the surface roughness (arithmetic mean height Sa) of the first uneven portion U of the substrate outer circumferential surface 20*a* is about 50 to 140 nm. Both have small unevenness, and thus, it is estimated that the unevenness are derived from the above-described surface roughening processing.

In addition, the surface roughness (arithmetic mean height Sa) of the unevenness having a relatively small value derived from the surface roughening processing and the like as in the above-mentioned third uneven portion W cannot be measured simultaneously with the surface roughness (Sa) of the unevenness having a relatively large value derived from cutting marks and the like, for example, as in the second uneven portion V at the time of measurement of the surface texture using a laser microscope or the like described later. Therefore, 80 μm is used as a cut-off value (center wavelength λc of filter correction) at the time of measurement of the arithmetic mean height Sa having a normal size, whereas 8 μm is used as a cut-off value (λc) at the time of measurement of the unevenness having a relatively small value as in the third uneven portion W. The value of the arithmetic mean height Sa of each of the uneven portions U to W is obtained in this manner (in the following second and third embodiments, the cut-off value is specified in the same manner).

Herein, in the cylindrical substrate 20 of the first embodiment, the chamfered face 20*b* is constituted by the second uneven portion V with relatively large unevenness and the third uneven portion W with small unevenness located on the surface of the second uneven portion V. The surface roughness Sa of the second uneven portion V is larger than the surface roughness Sa of the third uneven portion W.

With the above configuration, in the cylindrical substrate 20 of the first embodiment, the adhesion of the chamfered face 20*b* and the peripheral substrate end portion to the surface layer 13 is improved due to the anchor effect of the third uneven portion W of the chamfered face 20*b*. That is, regarding the cylindrical substrate 20, in the subsequent film formation step of the surface layer 13, abnormalities such as peeling or falling off of the film from the substrate end portion do not occur, and in the using step after the manufacturing the product, defects in the outer circumferential surface (printed portion) of the electrophotographic photoreceptor 1A caused by the peeling or falling off or image abnormalities or the like at the time of printing do not occur.

Therefore, also in a case where the cylindrical substrate 20 becomes a final product (electrophotographic photoreceptor 1A), the printing quality as designed can be stably maintained and reproduced.

In addition, in the first embodiment, an example is illustrated in which the chamfered face (20*b*) provided between the substrate outer circumferential surface and the substrate end face is a slant face (C-face), but the chamfered face may be configured as a curved face (R-face). An electrophotographic photoreceptor 1B in which the chamfered face is configured as a curved face (R-face) is illustrated in FIG. 3 (the second embodiment).

Figure 3A:
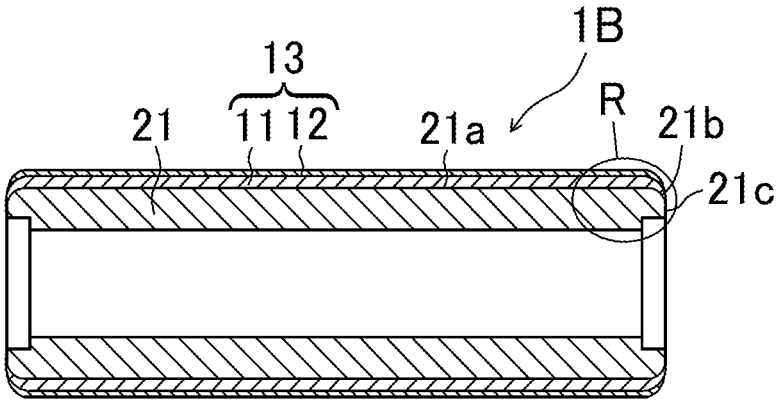
FIG. 3A is a cross-sectional view of an electrophotographic photoreceptor according to a second embodiment.
Figure 3B:
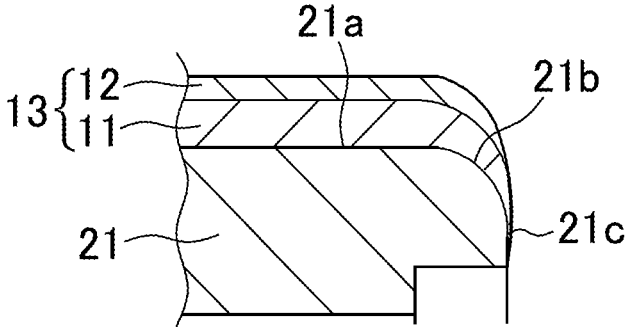
FIG. 3B is an enlarged cross-sectional view of a portion R of FIG. 3A.
Figure 3C:
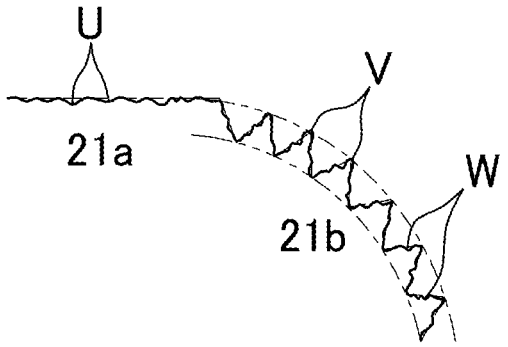
FIG. 3C is a schematic view illustrating an enlarged cross-sectional shape of the vicinity of the surface of a chamfered face of the electrophotographic photoreceptor.

FIG. 3A is a cross-sectional view of the electrophotographic photoreceptor 1B according to the second embodiment. FIG. 3B is an enlarged cross-sectional view of a portion R of FIG. 3A. FIG. 3C is a schematic view illustrating an enlarged cross-sectional shape of the vicinity of the surface of a chamfered face 21*b* of a cylindrical substrate 21.

The cylindrical substrate 21 according to the second embodiment illustrated in FIGS. 3A to 3C is different from the cylindrical substrate 20 described in the first embodiment (FIGS. 2A to 2C) in that the chamfered face 21*b* between a substrate outer circumferential surface 21*a* and a substrate end face 21*c* is configured as a curved face. In addition, the cylindrical substrate 21 subjected to the chamfering processing is subjected to the same surface roughening processing (for example, wet blast, polishing, or the like) as described above. Similarly to the first embodiment, the first uneven portion U with relatively small unevenness is formed on the surface of the substrate outer circumferential surface 21*a*. Furthermore, the second uneven portion V with relatively large unevenness is formed on the surface of the chamfered face 21*b* by chamfering processing and surface roughening processing, and the third uneven portion W with small unevenness is formed on the surface of the second uneven portion V (refer to FIG. 3C).

The surface roughness (arithmetic mean height Sa) of the second uneven portion V with relatively large unevenness on the surface of the chamfered face 21*b* is, for example, 180 to 1000 nm. In addition, the surface roughness (arithmetic mean height Sa) of the third uneven portion W formed on the surface of the second uneven portion V is about 90 to 140 nm. The surface roughness (Sa) of the first uneven portion U of the substrate outer circumferential surface 21*a* is about 90 to 140 nm.

In addition, in the measurement of the surface texture using a laser microscope or the like described later, 8 μm was used as a cut-off value (center wavelength λc of filter correction) at the time of measurement of the third uneven portion W, and 80 μm was used as a cut-off value (λc) at the time of measurement of the second uneven portion V.

Even with the above configuration, similarly to the first embodiment, in the cylindrical substrate 21, since the adhesion of the chamfered face 21*b* and the periphery thereof to the surface layer 13 is improved due to the anchor effect of the third uneven portion W of the chamfered face 21*b*, and thus, even in the film forming step of the surface layer 13 in the subsequent steps, abnormalities such as peeling or falling off of the film from the substrate end portion do not occur. Therefore, even in the final product (electrophotographic photoreceptor 1B), the printing quality as designed can be stably maintained and reproduced.

Figure 4A:
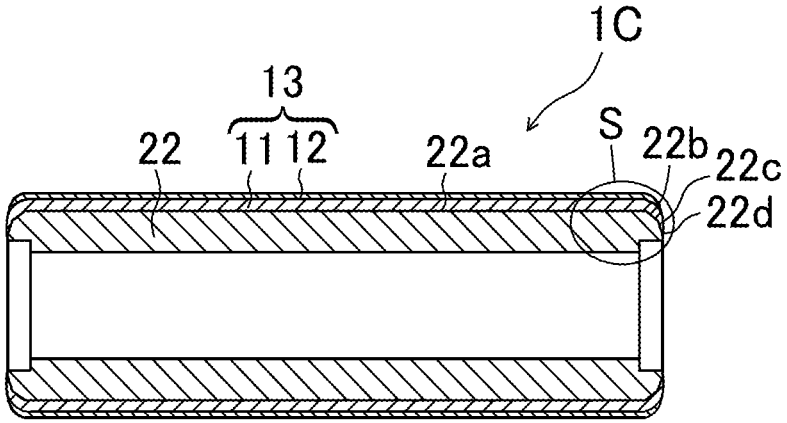
FIG. 4A is a cross-sectional view of an electrophotographic photoreceptor according to a third embodiment.
Figure 4B:
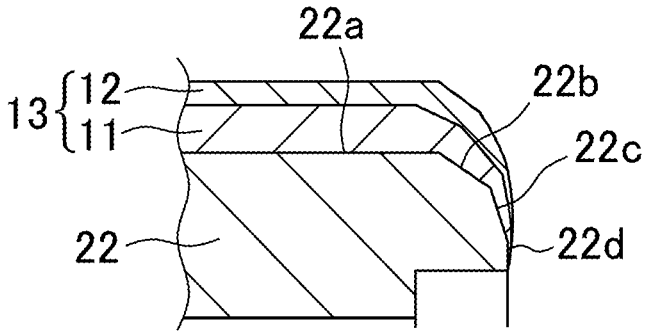
FIG. 4B is an enlarged cross-sectional view of a portion S of FIG. 4A.

Next, an example in which two-step slant face (chamfered face) having different slant angles is provided between the substrate outer circumferential surface and the substrate end face will be described. FIG. 4A is a cross-sectional view of the electrophotographic photoreceptor 1C according to the third embodiment. FIG. 4B is an enlarged cross-sectional view of a portion S of FIG. 4A.

A cylindrical substrate 22 of the third embodiment illustrated in FIGS. 4A and 4B has a substrate outer circumferential surface 22*a* having the shape and surface roughness similar to those of the cylindrical substrate 10 described in the embodiment (FIG. 1A and FIG. 1B) and a substrate end face 22*d* at the end portion in the cylindrical axial direction similar to that of the cylindrical substrate 10, as well. The cylindrical substrate 22 is different from the cylindrical substrate 10 in that an outer chamfered face 22*b* having a slant face (C-face) and an inner chamfered face 22*c* having a slant face as well, which are two (two-step) slant faces having different slant angles, are formed between the substrate outer circumferential surface 22*a* and the substrate end face 22*d* by chamfering processing using cutting or the like.

In addition, the chamfered face located in a cylinder outer side and continuing to the substrate outer circumferential surface 22*a* is called an outer chamfered face 22*b*. The chamfered face located between the outer chamfered face 22*b* and the substrate end face 22*d* is referred to as an inner chamfered face 22*c*. In addition, similarly to the first embodiment, a second uneven portion with relatively large unevenness such as that described above is formed on the outer chamfered face 22*b* and the inner chamfered face 22*c* by chamfering processing and surface roughening processing, and a third uneven portion with small unevenness is formed on the surface of the second uneven portion.

Herein, with paying attention to relatively small unevenness (corresponding to the third uneven portion) having an Sa of less than 140 nm which has a large contribution to the anchor effect to the surface layer to be formed later, when the measurement of the surface roughness (Sa) of the outer chamfered face 22*b* and the inner chamfered face 22*c* is performed with a cut-off value (λc) of 8 μm at the time of measurement of the surface texture using a laser microscope or the like described later, in the cylindrical substrate 22 illustrated in the figure, the surface roughness Sa of the outer chamfered face 22*b* becomes, for example, 90 nm or more and 140 nm or less, and the surface roughness Sa of the inner chamfered face 22*c* becomes, for example, 10 nm or more and 80 nm or less. In other words, the surface roughness Sa of the outer chamfered face 22*b* is larger than the surface roughness Sa of the inner chamfered face 22*c*.

On the other hand, with paying attention to relatively large unevenness (corresponding to the second uneven portion), when the measurement of the surface roughness Sa of the cylindrical substrate 22 is performed with a cut-off value (λc) of 80 μm at the time of measurement of the surface texture using a laser microscope or the like described later, in the cylindrical substrate 22 illustrated in the figure, generally, the surface roughness Sa of the substrate outer circumferential surface 22*a* becomes 1 nm or more and 140 nm or less, and surface roughness Sa of the outer chamfered face 22*b* becomes, for example, 180 nm or more and 1000 nm or less, and the surface roughness Sa of the inner chamfered face 22*c* also becomes, for example, 180 nm or more and 1000 nm or less. In other words, the surface roughness Sa of the outer chamfered face 22*b* is larger than the surface roughness Sa of the substrate outer circumferential surface 22*a*, and the surface roughness Sa of the inner chamfered face 22*c* is larger than the surface roughness Sa of the substrate outer circumferential surface 22*a*.

Also with the two configurations described above, in the cylindrical substrate 22 according to the third embodiment, the adhesion of the chamfered faces 22*b* and 22*c* and the peripheral substrate end portion to the surface layer 13 is improved due to the anchor effect of the third uneven portions of the two chamfered faces 22*b* and 22*c*, and the surface roughness (surface roughness Sa) of the outer chamfered face 22*b* close to the substrate outer circumferential surface 22*a* on which the film main body is to be formed is further increased. Therefore, also in the cylindrical substrate 22 according to the embodiment, also in the subsequent film formation step of the surface layer 13, the abnormalities such as peeling or falling off of the film from the substrate end portion do not occur, and defects in the outer circumferential surface (printed portion) of the electrophotographic photoreceptor 1C caused by the peeling or falling off, or image abnormalities or the like at the time of printing are prevented from occurring.

Furthermore, since the surface roughness Sa of the outer chamfered face 22*b* is larger than the surface roughness Sa of the substrate outer circumferential surface 22*a*, and the surface roughness Sa of the inner chamfered face 22*c* is larger than the surface roughness Sa of the substrate outer circumferential surface 22*a*, the adhesion of the substrate end portion to the surface layer 13 is further improved. Therefore, coupled with the anchor effect of the third uneven portion described above, the peeling and falling off of the film from the substrate end portion in the film formation step of the surface layer 13 can be further suppressed. In addition, similarly to the first and second embodiments, also in the using step where the cylindrical substrate 22 has become the final product (electrophotographic photoreceptor 1C), the printing quality as originally designed can be stably maintained and reproduced.

Figure 5:
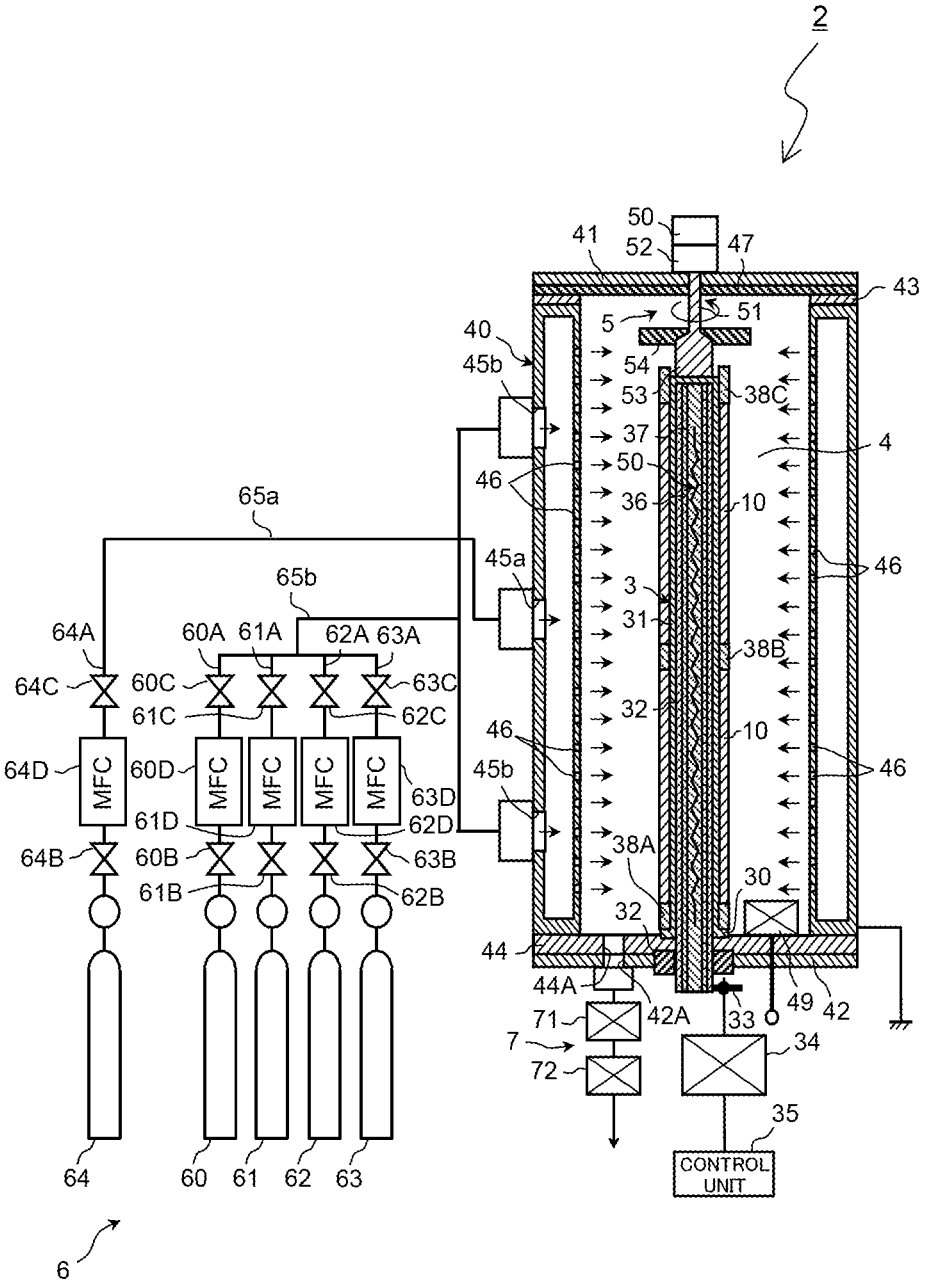
FIG. 5 is a longitudinal cross-sectional view of a deposition film forming apparatus.

The charge injection blocking layer 11*a*, the photoconductive layer 11*b*, and the surface protective layer 12 constituting the surface layer 13 of the electrophotographic photoreceptor 1 (including 1A to 1C) as described above are formed by using, for example, a plasma chemical vapor deposition (CVD) apparatus 2 illustrated in FIG. 5.

(Plasma CVD Apparatus)

The plasma CVD apparatus 2 accommodates a support 3 in a vacuum reaction chamber 4 and further includes rotating means 5, raw material gas supply means 6, and exhaust means 7.

The support 3 has a function of supporting the cylindrical substrate 10. The support 3 is formed in a hollow shape including a flange portion 30 and is entirely made of a conductive material similar to that of the cylindrical substrate 10 as a conductor.

A conductive support column 31 is entirely made of a conductive material similar to that of the cylindrical substrate 10 as a conductor and is fixed to a plate 42 described later at the center of the vacuum reaction chamber 4 (cylindrical electrode 40 described later) via an insulating material 32. A DC power supply 34 is connected to the conductive support column 31 via a guide plate 33. A control unit 35 is configured to supply a pulsed DC voltage to the support 3 via the conductive support column 31 by controlling the DC power supply 34.

A heater 37 is accommodated in the conductive support column 31 via a ceramic pipe 36.

Herein, the temperature of the support 3 is maintained in a certain range selected from, for example, 200° C. or higher and 400° C. or lower by turning on and off the heater 37.

The vacuum reaction chamber 4 is a space for forming a deposition film on the cylindrical substrate 10 and is defined by a pair of plates 41 and 42 bonded via the cylindrical electrode 40 and insulating members 43 and 44.

The cylindrical electrode 40 is formed in such a size that a distance Dl between the cylindrical substrate 10 supported by the support 3 and the cylindrical electrode 40 is 10 mm or more and 100 mm or less.

The cylindrical electrode 40 may be provided with gas inlets 45*a* and 45*b* and a plurality of gas blowing-off holes 46 and may be grounded at one end of the cylindrical electrode 40. In a case where the cylindrical electrode 40 is not grounded, the cylindrical electrode 40 may be connected to a reference power supply other than the DC power supply 34.

The gas inlet 45*a* has a function of introducing a dopant-dedicated raw material gas of the photoconductive layer 11*b* to be supplied to the vacuum reaction chamber 4. The gas inlet 45*b* has a function of introducing a raw material gas to be supplied to the vacuum reaction chamber 4. Each of the gas inlets 45*a* and 45*b* is connected to the raw material gas supply means 6.

The plurality of gas blowing-off holes 46 have a function of blowing off the raw material gas introduced into the cylindrical electrode 40 toward the cylindrical substrate 10. The plurality of gas blowing-off holes 46 are arranged at equal intervals in the vertical direction of the figure and also arranged at equal intervals in the circumferential direction.

By opening and closing the plate 41, the support 3 can be taken in and out of the vacuum reaction chamber 4. In the plate 41, an adhesion prevention plate 47 is attached to the lower surface side, and a deposition film on the plate 41 is prevented from being formed.

The plate 42 is a base of the vacuum reaction chamber 4. The insulating member 44 interposed between the plate 42 and the cylindrical electrode 40 has a function of suppressing the occurrence of arc discharge between the cylindrical electrode 40 and the plate 42.

The plate 42 and the insulating member 44 are provided with gas outlets 42A and 44A and a pressure gauge 49. The gas outlets 42A and 44A have a function of exhausting the gas inside the vacuum reaction chamber 4. The pressure gauge 49 connected to the exhaust means 7 has a function of monitoring the pressure of the vacuum reaction chamber 4. As the pressure gauge 49, various known pressure gauges can be used.

As illustrated in FIG. 5, the rotating means 5 has a function of rotating the support 3 and includes a rotation motor 50 and a rotational force transmission mechanism 51.

The rotation motor 50 exerts a rotational force to the cylindrical substrate 10. As the rotation motor 50, various known rotation motors can be used.

The rotational force transmission mechanism 51 has a function of transmitting and inputting the rotational force from the rotation motor 50 to the cylindrical substrate 10. The rotational force transmission mechanism 51 has a rotation introducing terminal 52, an insulating shaft member 53 and an insulating flat plate 54.

The rotation introducing terminal 52 has a function of transmitting a rotational force while maintaining the vacuum in the vacuum reaction chamber 4.

The insulating shaft member 53 and the insulating flat plate 54 have a function of inputting the rotational force from the rotation motor 50 to the support 3 while maintaining the insulation state between the support 3 and the plate 41. The insulating shaft member 53 and the insulating flat plate 54 are made of, for example, the same insulating material as the insulating member 44 or the like.

The insulating flat plate 54 has a function of preventing foreign substances such as dirt and dust falling from above from adhering to the cylindrical substrate 10 in the case of detaching the plate 41.

As illustrated in FIG. 5, the raw material gas supply means 6 includes a plurality of raw material gas tanks 60, 61, 62, and 63, a dopant-dedicated gas tank 64 of the photoconductive layer 11*b*, a plurality of pipes 60A, 61A, 62A, 63A, and 64A, valves 60B, 61B, 62B, 63B, 64B, 60C, 61C, 62C, 63C, and 64C, and a plurality of mass flow controllers 60D, 61D, 62D, 63D, and 64D and is connected to the cylindrical electrode 40 via the pipes 65*a* and 65*b* and the gas inlets 45*a* and 45*b*. Each of the raw material gas tanks 60 to 64 is filled with, for example, $B_2H_6$ (or $PH_3$), $H_2$ (or He), $CH_4$, or $SiH_4$. The valves 60B to 64B and 60C to 64C and the mass flow controllers 60D to 64D have a function of adjusting the flow rate, the composition, and the gas pressure of each raw material gas component introduced into the vacuum reaction chamber 4 or the component of the dopant-dedicated gas of the photoconductive layer 11*b*.

The exhaust means 7 has a function of exhausting the gas of the vacuum reaction chamber 4 to the outside through the gas outlets 42A and 44A. The exhaust means 7 includes a mechanical booster pump 71 and a rotary pump 72. These pumps 71 and 72 are controlled in operation according to the monitoring result of the pressure gauge 49.

As described above, such a plasma CVD apparatus 2 can continuously perform surface roughing and a process of forming the photosensitive layer 11 and the surface protective layer 12 while maintaining the vacuum state in the vacuum reaction chamber 4 in one apparatus. The plasma CVD apparatus 2 is an example of an apparatus of manufacturing an electrophotographic photoreceptor including a surface roughing unit, a charge injection blocking layer forming unit, a photoconductive layer forming unit, and a surface protective layer forming unit.

(Method of Forming Deposition Film)

Next, with respect to a method of forming a deposition film by using the plasma CVD apparatus 2, as an example, there will be described the case of manufacturing the electrophotographic photoreceptor 1 (refer to FIGS. 1A and 1B) in which an amorphous silicon (a-Si) film as the photosensitive layer 11, an amorphous silicon carbide (a-SiC) film, and amorphous carbon (a-C) film as the surface protective layer 12 are stacked on the cylindrical substrate 10.

First, in forming the deposition film (a-Si film) on the cylindrical substrate 10, after detaching the plate 41 of the plasma CVD apparatus 2, the support 3 supporting a plurality of the cylindrical substrates 10 (two in the drawing) is set inside the vacuum reaction chamber 4, and the plate 41 is attached again.

In order to support the two cylindrical substrates 10 with respect to the support 3, a lower dummy substrate 38A, the cylindrical substrate 10, an intermediate dummy substrate 38B, the cylindrical substrate 10, and an upper dummy substrate 38C are sequentially stacked on the flange portion 30 so as to cover the main portion of the support 3.

As each of the dummy substrates 38A to 38C, the dummy substrate obtained by applying conduction treatment to the surface of a conductive or insulating substrate is selected according to the application of the product, but generally, a substrate formed in a cylindrical shape using a material similar to that of the cylindrical substrate 10 is used.

Herein, the lower dummy substrate 38A has a function of adjusting the height position of the cylindrical substrate 10. The intermediate dummy substrate 38B has a function of suppressing the occurrence of film formation defects on the cylindrical substrate 10 caused by the arc discharge generated between the end portions of the adjacent cylindrical substrates 10. The upper dummy substrate 38C has a function of preventing the deposition film from being formed on the support 3 and of suppressing the occurrence of film formation defects caused by the peeling of a film formation body which has been once deposited during the film formation.

Next, the vacuum reaction chamber 4 is sealed. The cylindrical substrate 10 is rotated by the rotating means 5 via the support 3, and the cylindrical substrate 10 is heated. The vacuum reaction chamber 4 is depressurized by the exhaust means 7.

The cylindrical substrate 10 is heated, for example, by externally supplying power to the heater 37 to cause the heater to generate heat. The temperature of the cylindrical substrate 10 is set, for example, in a range of 250° C. or more and 300° C. or less in the case of forming an amorphous silicon (a-Si) film.

On the other hand, the depressurization of the vacuum reaction chamber 4 is performed by exhausting the gas from the vacuum reaction chamber 4 through the gas outlets 42A and 44A by the exhaust means 7. The degree of depressurization of the vacuum reaction chamber 4 may be, for example, about $10^{-3}$ Pa while monitoring with the pressure gauge 49 (refer to FIG. 5).

Subsequently, in a case where the temperature of the cylindrical substrate 10 becomes a desired temperature and the pressure of the vacuum reaction chamber 4 becomes a desired pressure, the raw material gas is supplied to the vacuum reaction chamber 4 by the raw material gas supply means 6, and a pulsed DC voltage is applied between the cylindrical electrode 40 and the support 3. As a result, glow discharge occurs between the cylindrical electrode 40 and the cylindrical substrate 10, and thus, the raw material gas component is decomposed, so that the decomposed components of the raw material gas are deposited on the surface of the cylindrical substrate 10.

On the other hand, by the exhaust means 7, the gas pressure in the vacuum reaction chamber 4 is maintained in a target range. The gas pressure in the vacuum reaction chamber 4 may be, for example, 1 Pa or more and 100 Pa or less.

The supply of the raw material gas to the vacuum reaction chamber 4 is performed by introducing the raw material gases of the raw material gas tanks 60 to 64 with desired composition and flow rates into the inside of the cylindrical electrode 40 through the pipes 60A to 64A, 65*a*, and 65*b* and the gas inlets 45*a* and 45*b* by appropriately controlling the opened/closed states of the valves 60B to 64B and 60C to 64C and controlling the mass flow controllers 60D to 64D. Then, the charge injection blocking layer 11*a*, the photoconductive layer 11*b*, and the surface protective layer 12 are sequentially formed on the surface of the cylindrical substrate 10 by appropriately switching the composition of the raw material gases.

The application of the pulsed DC voltage between the cylindrical electrode 40 and the support 3 is performed by controlling the DC power supply 34 by the control unit 35.

The pulsed DC voltage is applied so that the cylindrical substrate 10 side has either positive or negative polarity to accelerate cations and cause the cations to collide with the cylindrical substrate 10. In a case where the film formation of amorphous silicon (a-Si) is performed while the fine unevenness of the surface is sputtered by the collision, the amorphous silicon (a-Si) including a surface with highly uniform unevenness in which the growth of large protrusions is suppressed is obtained. Hereinafter, in some cases, this phenomenon may be referred to as an ion sputtering effect.

In order to efficiently obtain the ion sputtering effect in such a plasma CVD method, it is necessary to apply power so as to avoid continuous inversion of the polarity, and in addition to the pulsed rectangular wave, a triangular wave, a DC voltage without inversion of polarity are useful. In addition, the same effect can be obtained with an AC voltage or the like adjusted so that all voltages have either positive or negative polarity.

Herein, in order to efficiently obtain the ion sputtering effect by the pulsed voltage, the potential difference between the support 3 (cylindrical substrate 10) and the cylindrical electrode 40 may be, for example, in a range of 50 V or more and 3000 V or less. In a case where the film formation rate is considered, more specifically, the potential difference may be in a range of 500 V or more and 3000 V or less.

The control unit 35 also controls the DC power supply 34 so that the frequency (1/T (sec)) of the DC voltage is 300 kHz or less and the duty ratio (T1/T) is 20% or more and 90% or less.

In addition, the duty ratio in the embodiment is defined as a ratio of time taken by a potential difference generation time T1 in one cycle (T) of a pulsed DC voltage (time period from the moment when the potential difference is generated between the cylindrical substrate 10 and the cylindrical electrode 40 to the moment when the potential difference is generated next).

Even if the thickness of the photoconductive layer 11*b* made of the amorphous silicon (a-Si) obtained by using the ion sputtering effect is 10 μm or more, highly uniform unevenness in which the growth of large protrusions is suppressed such as that described above, exists on the surface. For this reason, amorphous silicon carbide (a-SiC) and amorphous carbon (a-C) as the surface protective layer 12 may be stacked in a total thickness of about 1 μm on the outer surface of the photoconductive layer 11*b*. The surface shape of the surface protective layer 12 in this case can be a surface reflecting the surface shape of the photoconductive layer 11*b*. That is, even in a case where the surface protective layer 12 is stacked on the photoconductive layer 11*b*, the surface protective layer 12 can be formed as the film having highly uniform unevenness in which the growth of large protrusions is suppressed by using the ion sputtering effect.

For example, in a case where the charge injection blocking layer 11*a* is formed as a deposition film made of amorphous silicon (a-Si)-based material, a mixed gas of a silicon (Si)-containing gas such as $SiH_4$ (silane gas), a dopant-containing gas such as $B_2H_6$ or $PH_3$, and a dilution gas of hydrogen ($H_2$), helium (He), or the like is used as a raw material gas. As the dopant-containing gas, a gas containing nitrogen (N)-containing gas or oxygen (O)-containing gas or both thereof may be used in the case of a boron (B)-containing gas, or a gas containing nitrogen (N)-containing gas or oxygen (O)-containing gas or both thereof may be used in the case of a phosphorus (P)-containing gas.

In a case where the photoconductive layer 11*b* is formed as a deposition film made of amorphous silicon (a-Si)-based material, a mixed gas of a silicon (Si)-containing gas such as $SiH_4$ (silane gas) and a dilution gas of hydrogen ($H_2$), helium (He), or the like may be used as raw material gases. In the photoconductive layer 11*b*, a hydrogen gas may be used as a dilution gas so that hydrogen (H) or a halogen element (fluorine (F) or chlorine (Cl)) is contained in the film in an amount of 1 atomic % or more and 40 atomic % or less for termination of dangling bonds, or a halogen compound may be contained in the raw material gas.

The surface protective layer 12 is formed as a multilayer structure of the a-SiC layer and the a-C layer as described above. In this case, as the raw material gas, a silicon (Si)-containing gas such as $SiH_4$ (silane gas) and a C-containing gas such as $C_2H_2$ (acetylene gas) or $CH_4$ (methane gas) are used. Herein, the a-C layer which is the third layer of the surface protective layer 12 may have a thickness of usually 0.01 μm or more and 2 μm or less, specifically 0.02 μm or more and 1 μm or less, more specifically 0.03 μm or more and 0.8 μm or less. In addition, the surface protective layer 12 may have a thickness of usually 0.1 μm or more and 6 μm or less, specifically 0.25 μm or more and 3 μm or less, more specifically 0.4 μm or more and 2.5 μm or less.

As described above, in a case where the film formation on the cylindrical substrate 10 is completed, the electrophotographic photoreceptor 1 illustrated in FIG. 1 can be obtained by extracting the cylindrical substrate 10 from the support 3.

(Image Forming Apparatus)

An image forming apparatus according to an embodiment of the invention will be described with reference to FIG. 6.

Figure 6:
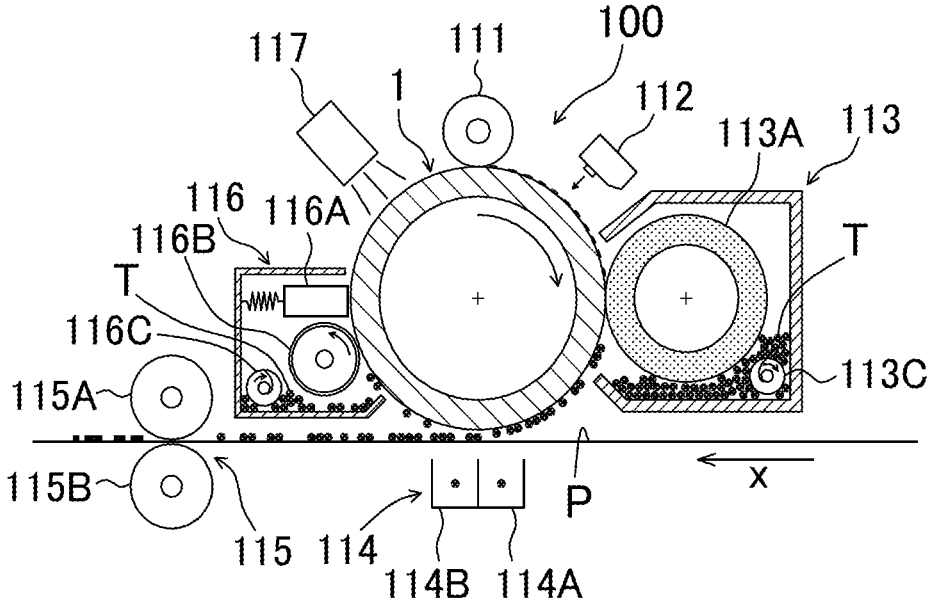
FIG. 6 is a cross-sectional view illustrating an image forming apparatus according to an embodiment of the invention.

The image forming apparatus illustrated in FIG. 6 employs a Carlson method as an image forming method and includes the electrophotographic photoreceptor 1, a charging device 111, an exposure device 112, a developing device 113 including a magnetic roller 113A and a transporting screw 113C for stirring unused toner, a transfer device 114, a fixing device 115 (115A and 115B), a cleaning device 116 including a cleaning blade 116A and a cleaning roller 116B which contact the electrophotographic photoreceptor and a toner transporting screw 116C for discharging residual toner, and a static eliminating device 117. In addition, the arrow x in the drawing indicates the moving direction of the paper which is the recording medium P.

The charging device (charging roller) 111 has a function of charging the surface of the electrophotographic photoreceptor to a negative polarity. In the embodiment, as the charging device 111, for example, a contact charging device configured by covering a core metal with a conductive rubber or PVDF (polyvinylidene fluoride) is employed.

The exposure device 112 has a function of forming an electrostatic latent image on the electrophotographic photoreceptor 1. As the exposure device 112, for example, a light emitting diode (LED) head in which a plurality of LED elements (wavelength: 680 nm) are arrayed can be employed.

The developing device 113 has a function of developing an electrostatic latent image of the electrophotographic photoreceptor 1 to form a toner image. The developing device 113 in the present example is provided with a magnetic roller 113A that retains the developer (toner) T magnetically.

The developer (toner) T constitutes a toner image formed on the surface of the electrophotographic photoreceptor 1 and is frictionally charged in the developing device 113. As the developer T, there are exemplified a two-component developer including a magnetic carrier and an insulating toner and a one-component developer including a magnetic toner.

The magnetic roller 113A has a function of transporting the developer to the surface (developing region) of the electrophotographic photoreceptor 1. The magnetic roller 113A transports the developer T, which is frictionally charged in the developing device 113, in the form of a magnetic brush adjusted to a constant brush length. The transported developer T adheres to the surface of the electrophotographic photoreceptor 1 by electrostatic attraction with the electrostatic latent image in the developing region of the electrophotographic photoreceptor 1 to form a toner image (to visualize the electrostatic latent image).

In addition, although the developing device 113 employs a dry development method in the present example, a wet development method using a liquid developer may be employed. In addition, in some cases, in the developing device 113, the transporting screw 113C (spiral type) for stirring the unused toner T1 is arranged.

The transfer device 114 has a function of transferring the toner image of the electrophotographic photoreceptor 1 to the recording medium P supplied to a transfer region between the electrophotographic photoreceptor 1 and the transfer device 114. The transfer device 114 in the present example includes a transfer charger 114A and a separation charger 114B.

As the transfer device 114, in some cases, a transfer roller which follows the rotation of the electrophotographic photoreceptor 1 and which is arranged via a minute gap (for example, 0.5 mm or less) with the electrophotographic photoreceptor 1 may be used. The transfer roller is configured so that a transfer voltage for attracting the toner image on the electrophotographic photoreceptor 1 onto the recording medium P is applied, for example, by a DC power supply.

The fixing device 115 has a function of fixing the toner image transferred to the recording medium P to the recording medium P and includes a pair of fixing rollers 115A and 115B. The fixing rollers 115A and 115B are obtained, for example, by coating the surface of a metal roller with tetrafluoroethylene or the like.

The cleaning device 116 has a function of removing toner remaining on the surface of the electrophotographic photoreceptor 1 and includes the cleaning roller 116B and the cleaning blade 116A. The cleaning roller 116B is in a shape of a crown having a large diameter at the center and is in sliding contact with the outer circumference of the electrophotographic photoreceptor 1 and forms a toner film for surface cleaning, which is made of residual toner therebetween. The cleaning blade 116A has a function of scraping the residual toner from the surface of the electrophotographic photoreceptor 1. The cleaning blade 116A is made of, for example, a rubber material containing a polyurethane resin as a main component.

The static eliminating device 117 has a function of removing surface charges of the electrophotographic photoreceptor 1. The static eliminating device can emit light having a specific wavelength (for example, 630 nm or more). The static eliminating device 117 is configured to remove the surface charges (remaining electrostatic latent image) of the electrophotographic photoreceptor 1 by irradiating the entire surface of the electrophotographic photoreceptor 1 in the axial direction with light from a light source such as an LED.

In an image forming apparatus 100 according to the embodiment, it is possible to exhibit the above-described effects of the electrophotographic photoreceptor 1.

Example 1

The electrophotographic photoreceptor 1 according to the embodiment of the invention was evaluated as follows.

With Respect to Manufacturing Electrophotographic Photoreceptor 1

<Cylindrical Substrate 10>

The cylindrical substrate 10 was manufactured by using an aluminum alloy raw tube (outer diameter: 30 mm and length: 360 mm). The outer surface of the cylindrical substrate 10 was subjected to surface mirroring processing and wet blasting processing and cleaned.

First, as the surface mirroring processing of the surface of the cylindrical substrate 10, the cylindrical substrate 10 was retained at both ends thereof, and in a state of rotating at a high speed of 1500 to 8000 rpm, a diamond turning tool was pressed against the cylindrical substrate 10, and vanishing processing was performed at a feed of 0.08 to 0.5 mm. That is, a smooth finished surface was obtained by pressing the surface of the cylindrical substrate 10 with the diamond turning tool having a depth in the direction of workpiece rotation on the finishing surface of the turning tool.

After the surface mirroring processing, the cylindrical substrate 10 was degreased and cleaned.

Next, as the wet blasting processing, a high-hardness abrasive such as alumina and water are stirred and accelerated while being mixed with compressed air, and the surface of the surface-mirroring-processed cylindrical substrate 10 was roughened by projecting the abrasive. Accordingly, by processing while rotating the cylindrical substrate 10, it is possible to form a processed surface with excellent uniformity in a short time. As in the embodiment, according to the wet blasting processing, as compared with other processing methods, uniformly projecting the abrasive having a small particle size can be relatively easily performed, so that it is possible to obtain a processed surface with excellent uniformity.

Specifically, samples of the cylindrical substrate 10 having 15 types of different surfaces listed in Table 2 described later were prepared by adjusting the following parameters as the conditions for the wet blasting processing.

Material and Particle Size of Abrasive: A (alundum (brown dissolved alumina)) #320 to #4000

Concentration of Abrasive: 10 to 18%

Projection Air Pressure: 0.10 to 0.35 MPa

Projection Distance (Distance between Workpiece Center and Blast Head): 20 to 300 mm Projection Time: 1 to 60 seconds Workpiece Speed: 120 to 180 rpm In addition, the value of Sal was adjusted by using abrasives having different materials and particle sizes, and the value of Str was adjusted by changing the projection air pressure, the projection distance, and the projection time (1 to 60 seconds).

Next, after performing the wet blasting, the residue remaining on the surface is cleaned and removed to prepare the cylindrical substrate 10 for forming the surface layer. The cleaning to remove the residue (residue cleaning process) is performed in the order of shower cleaning with water ultrasonic cleaning—blowing (blowing with compressed air)—heater drying.

The cylindrical substrate 10 prepared in this manner is transported into a clean room, subjected to precision cleaning for removing oil components and the like, and then set in the plasma CVD apparatus illustrated in FIG. 5. After the setting, the surface layer 13 including the charge injection blocking layer 11*a*, the photoconductive layer 11*b*, and the surface protective layer 12 is formed on the surface of the cylindrical substrate 10 under the conditions listed in Table 1.

TABLE 1

| Type of layer | | Charge injection blocking layer | Photo-conductive layer | Surface layer First layer | Surface layer Second layer | Surface layer Third layer |
|---|---|---|---|---|---|---|
| Type of gas | $SiH_4$ (sccm) | 170 | 340 | 30 | 6 | — |
| | $H_2$ (sccm) | 200 | 200 | — | — | — |
| | $B_2H_6$* | 0.10% | 0.3 ppm | — | — | — |
| | $CH_4$ (sccm) | — | — | 600 | 600 | 600 |
| | NO* | 10% | — | — | — | — |
| Pressure (Pa) | | 60 | 60 | 60 | 60 | 60 |
| Substrate temperature (° C.) | | 300 | 300 | 250 | 250 | 250 |
| DC voltage (V) | | −900 | −1000 | −400 | −400 | −400 |
| Pulse Frequency (KHz) | | 50 | 50 | 50 | 50 | 50 |
| Duty Ratio (%) | | 70 | 70 | 70 | 70 | 70 |
| Thickness (μm) | | 5 | 14 | 0.3 | 0.7 | 0.2 |

*Flow ratio to $SiH_4$ gas

The flow rates of $B_2H_6$ and NO in Table 1 are expressed as a ratio to the flow rate of $SiH_4$. In addition, a DC pulse power supply (pulse frequency: 50 kHz and duty ratio: 70%) was used as a power supply of the plasma CVD apparatus. In addition, the film thickness was measured by analyzing the cross section with a scanning electron microscope (SEM) and an X-ray microanalyzer (XMA). The specific configuration of each layer is as follows.

<Charge Injection Blocking Layer>

The charge injection blocking layer 11*a* is formed by adding boron (B) as a dopant to an amorphous silicon (a-Si)-based material obtained by adding nitrogen (N) and oxygen (O) to amorphous silicon (a-Si).

The film thickness of the charge injection blocking layer 11*a* was set to 5 μm.

<Photoconductive Layer>

The photoconductive layer 11*b* is formed by adding boron (B) as a dopant to an amorphous silicon (a-Si)-based material obtained by adding carbon (C), nitrogen (N), oxygen (O), and the like to amorphous silicon (a-Si).

The film thickness of the photoconductive layer 11*b* was set to 14 μm.

<Surface Protective Layer>

The surface protective layer 12 has a configuration in which amorphous silicon carbide (a-SiC) and amorphous carbon (a-C) are stacked.

The film thickness of the surface protective layer 12 was set to 1.2 μm in total, and the film thickness of the third layer of the surface protective layer was set to 0.2 μm.

Herein, Samples 1 to 15 of the electrophotographic photoreceptor 1 were produced by changing the surface roughness of the surface protective layer 12.

The surface textures of the surface protective layer 12 of Samples 1 to 15 of the electrophotographic photoreceptor 1 obtained as described above were measured.

The measurement as the evaluation of the surface shape with the three-dimensional roughness parameter based on IS025178 was performed by a three-dimensional measurement laser microscope OLS4100 produced by Olympus Co., Ltd. As a measurement condition, a 50-fold magnification lens was used, and a range of 260 μm×261 μm was measured in a high-speed measurement mode. Since the measurement object has a cylindrical shape, the correction was performed by correcting the curvature in the X and Y directions. In addition, in order to eliminate the influence of the periodic streaks of turning, the filter correction with the central wavelength λc=0.080 mm was developed, and each parameter was calculated. In addition, the measurement result herein is an arithmetic mean of the measurement results of five positions within a range of 100 mm in the central portion in the axial direction of the cylindrical substrate 10 of the electrophotographic photoreceptor 1.

The Str and Sal of each sample are as listed in Table 2 described later.

Subsequently, each sample of the manufactured electrophotographic photoreceptor 1 was incorporated into a color multifunction apparatus "TASKalfa 3550ci remodeling apparatus" manufactured by KYOCERA Document Solutions Inc., and for each sample, evaluation of an Sa reduction rate (%) of the surface protective layer 12 of the electrophotographic photoreceptor 1, evaluation of a scratch of the cleaning blade 116A which is a peripheral member of the electrophotographic photoreceptor 1 and evaluation of the image characteristics by observing the surface contamination state of the charging roller at the time of continuous printing of 600,000 sheets (600 k) were performed. Then, comprehensive evaluation was performed, which is comprehensive evaluation on the basis of those individual characteristics.

Evaluation of each of the above-mentioned individual characteristics was performed under the following conditions. That is, under the evaluation environment of a room temperature of 23° C. and a relative humidity of 60%, at the time of continuous printing of 200,000 sheets, the time of continuous printing of 400,000 sheets, and the time of continuous printing of 600,000 sheets, the measurement of the surface texture of the electrophotographic photoreceptor 1 by the above-mentioned laser microscope and the observation of the presence or absence of scratches on the edge portion of the cleaning blade 116A and the surface contamination state of the charging roller by a magnifying glass (20-fold magnification) were performed.

Herein, the Sa reduction rate (%) indicates the rate at which the value of Sa on the surface protective layer of the electrophotographic photoreceptor 1 is reduced from the initial value before the printing, and, for example, a case where the rate is described as 70% denotes that the value of Sa is 30% of that in the state before printing. In addition, in the data of the Sa reduction rate (%), the value marked with "*" indicates the Sa reduction rate (%) of the surface protective layer 12 of the electrophotographic photoreceptor 1 at the time of continuous printing of 200,000 sheets (200 k).

In addition, a damage mode of the cleaning blade 116A is as follows. Evaluation A indicates that, as a result of continuous printing of 200,000 sheets (200 k), some damages were observed on the cleaning blade 116A. Evaluation B indicates that clear damages were observed on the cleaning blade 116A at the time of small number of times of printing of 1000 or less.

The evaluation results are listed in Table 2.

TABLE 2

| | Individual characteristics | | | | | | |
|---|---|---|---|---|---|---|---|
| | Surface state of surface layer | | Sa reduction rate during durable use, 600k | Damage of | Damage | Image | Comprehensive |
| Sample No. | Str | Sal | [%] | blade | mode | characteristics | evaluation |
| 1 | 0.59 | 0.9 | 64* | Poor | A | Available | Available |
| 2 | 0.67 | 1.0 | 65* | Available | A | Good | Good |
| 3 | 0.79 | 0.9 | 68* | Available | A | Good | Good |
| 4 | 0.58 | 1.6 | — | Poor | B | Available | Available |
| 5 | 0.68 | 1.8 | 70 | Excellent | — | Excellent | Excellent |
| 6 | 0.79 | 1.6 | 76 | Excellent | — | Excellent | Excellent |
| 7 | 0.59 | 4.6 | — | Poor | B | Available | Available |
| 8 | 0.67 | 4.5 | 57 | Good | — | Excellent | Excellent |
| 9 | 0.79 | 4.7 | 66 | Excellent | — | Excellent | Excellent |
| 10 | 0.58 | 9.7 | — | Poor | B | Poor | Poor |
| 11 | 0.67 | 10.3 | 45 | Good | — | Excellent | Excellent |
| 12 | 0.79 | 10.0 | 54 | Good | — | Excellent | Excellent |
| 13 | 0.59 | 14.5 | — | Poor | B | Poor | Poor |
| 14 | 0.67 | 14.7 | — | Poor | B | Poor | Poor |
| 15 | 0.79 | 14.7 | — | Poor | B | Poor | Poor |

In Table 2, "Excellent" indicates that the sample has excellent properties, "Good" indicates that the sample has favorable properties, "Available" indicates that the sample has a required level of properties, and "Poor" indicates that the sample does not satisfy a required level of properties.

That is, the following was found from the results of Table 2.

In the electrophotographic photoreceptor 1, except for cases where the initial defect occurs due to the value of Sal (Samples 14 and 15), in cases where the value of Str is 0.67 or more (Samples 2, 3, 5, 6, 8, 9, 11, and 12), it was found that excellent effects were exhibited. Among them, in a case where the value of Str is 0.79 or more (Samples 3, 6, 9, and 12), it was found that more excellent effects were exhibited.

According to these experimental data, when the value of Str is a predetermined value or more, the surface shape of the surface protective layer 12 has unevenness with high uniformity, so that the surface roughness can be maintained within a certain range even if the surface is gradually abraded during durable use. As a result, it is possible to continue to effectively suppress the increase in frictional resistance between the surface protective layer 12 and the cleaning roller 116B or the cleaning blade 116A. It is considered that the defect of the cleaning blade 116A can be suppressed accordingly, and thus, image abnormalities such as abnormal streaks in the printed image can be reduced. In addition, it is considered that, as the cause of the initial defect in Samples 14 and 15, when the value of Sal is large, the frictional resistance with the cleaning roller and cleaning blade as peripheral members is large, and thus the defect of the cleaning blade 116A occurs.

In addition, the following was found under the condition that the value of Str was 0.67 or more. That is, in cases where the value of Sal was 10.3 μm or less (Samples 2, 3, 5, 6, 8, 9, 11, and 12), it was found that excellent effects were exhibited. According to these experimental data, it is considered that, when Sal is smaller than a predetermined value, it is possible to reduce the frictional resistance between the surface protective layer 12 of the electrophotographic photoreceptor 1 and the cleaning roller 116B or the cleaning blade 116A, thereby suppressing the defect of the cleaning blade 116A, so that it is possible to obtain excellent durability characteristics.

In addition, in cases where the value of Sal was 0.9 μm or more (Samples 2, 3, 5, 6, 8, 9, 11, and 12), it was found that excellent effects were exhibited. Furthermore, in cases where the value of Sal was 1.6 μm or more (Samples 5, 6, 8, 9, 11, and 12), it was found that more excellent effects were exhibited. According to these experimental data, it is considered that, when Sal is larger than a predetermined value, the abrasion of the surface protective layer 12 of the electrophotographic photoreceptor 1 is reduced, thereby suppressing the defect of the cleaning blade 116A, so that it is possible to obtain excellent durability characteristics.

Example 2

Next, the electrophotographic photoreceptors 1A and 1C provided with the "chamfered face" at the end portion of the cylindrical substrate described in the first to third embodiments were evaluated as follows.

<Cylindrical Substrate>

The cylindrical substrate was manufactured by using an aluminum alloy raw tube (outer diameter: 30 mm and length 360 mm) as in Example 1. The outer surface of the cylindrical substrate was subjected to surface mirroring processing including chamfering processing, and then wet blasting processing and cleaned.

First, the chamfered faces 20*b* with relatively large unevenness (second uneven portion V) were manufactured at both end portions of the cylindrical substrate by cutting using a turning chip. Next, as the surface mirroring processing of the surface of the cylindrical substrate, the cylindrical substrate was retained, and in a state of rotating at a high speed of 1500 to 8000 rpm, the diamond turning tool was pressed, and vanishing processing was performed at a feed of 0.08 to 0.5 mm, so that a smooth finished surface (mirror surface) was obtained.

Next, by the surface roughening processing (wet blasting processing) similar to that in Example 1, the first uneven portion U with relatively small unevenness is formed on the surface of the substrate outer circumferential surface 20*a*, and the same wet blasting processing was also performed on the surface of the chamfered face 20*b* to form the third uneven portion W with small unevenness on the surface of the second uneven portion V (chamfered face 20*b*) (refer to FIG. 3C). In addition, cylindrical substrates, that is, Sample Nos. 16 to 24, as raw tubes of an electrophotographic photoreceptor which exhibits the surface texture in "Table 3" were manufactured by changing each processing condition of surface mirroring processing, chamfering processing and surface roughening processing.

<Formation of Surface Layer>

Next, similarly to Example 1, a surface layer was formed on each of Sample Nos. 16 to 24 by using the plasma CVD apparatus 2. The outer surface (printed portion) of the electrophotographic photoreceptor after the completion was visually observed, and the quality as an electrophotographic photosensitive product was determined on the basis of the presence or absence of "film peeling". In the evaluation, a product with little occurrence of film peeling was evaluated as "Good", a product with film peeling marks being seen but with no problem in the printed portion was evaluated as "Available", and a product with film peeling occurring and with the printed portion being affected was evaluated as "Poor". The results are listed in "Table 3".

TABLE 3

| Sample No. | Sa (nm) First uneven portion | Second uneven portion | Third uneven portion | Film peeling |
|---|---|---|---|---|
| 16 | 3 | 222 | 68 | Available |
| 17 | 4 | 556 | 73 | Available |
| 18 | 6 | 536 | 79 | Available |
| 19 | 69 | 572 | 80 | Available |
| 20 | 71 | 770 | 119 | Good |
| 21 | 73 | 840 | 114 | Good |
| 22 | 90 | 210 | 95 | Good |
| 23 | 110 | 234 | 117 | Good |
| 24 | 120 | 236 | 130 | Good |
| Cut-off value | 80 μm | 80 μm | 8 μm | — |

In addition, in the same manner as described above, cylindrical substrates, that is, Sample Nos. 25 to 32 and Sample Nos. 33 to 38, as raw tubes of an electrophotographic photoreceptor in which a two-step chamfered face configured with the outer chamfered face 22*b* and the inner chamfered face 22*c* was formed at the end portion of an aluminum alloy raw tube similar to that of Example 1 were manufactured. The surface textures of these samples are summarized in "Table 4" and "Table 5".

Then, as in the first embodiment, a surface layer was formed on each sample by using the above-described plasma CVD apparatus 2. The outer surface (printed portion) of the electrophotographic photoreceptor after the completion was visually observed, and the quality as an electrophotographic photosensitive product was determined and evaluated on the basis of the presence or absence of "film peeling". The results are listed in "Table 4" and "Table 5".

TABLE 4

| Sample No. | Sa (nm) Outer chamfered face | Inner chamfered face | Film peeling |
|---|---|---|---|
| 25 | 71 | 61 | Available |
| 26 | 79 | 74 | Available |

TABLE 4-continued

| Sample No. | Sa (nm) Outer chamfered face | Inner chamfered face | Film peeling |
|---|---|---|---|
| 27 | 75 | 71 | Available |
| 28 | 69 | 64 | Available |
| 29 | 95 | 51 | Good |
| 30 | 114 | 62 | Good |
| 31 | 119 | 71 | Good |
| 32 | 130 | 73 | Good |
| Cut-off value | 8 μm | | — |

TABLE 5

| Sample No. | Sa (nm) Outer circumferential surface | Outer chamfered face | Inner chamfered face | Film peeling |
|---|---|---|---|---|
| 33 | 3 | 154 | 145 | Available |
| 34 | 6 | 229 | 211 | Good |
| 35 | 71 | 160 | 155 | Available |
| 36 | 73 | 770 | 259 | Good |
| 37 | 110 | 150 | 144 | Available |
| 38 | 114 | 234 | 235 | Good |
| Cut-off value | | 80 μm | | — |

It is found from the results of Table 3 described above that, in the electrophotographic photoreceptors of Sample Nos. 20 to 24 where the surface roughness Sa of the second uneven portion V is larger than the surface roughness Sa of the third uneven portion in the chamfered face 20*b*, abnormalities such as peeling or falling off of the film from the substrate end portion do not occur even during deposition of the surface layer, and defects in the outer circumferential surface (printed portion) of the electrophotographic photoreceptor 1A caused by the peeling or falling off, or image abnormalities or the like at the time of printing do not occur. In addition, the electrophotographic photoreceptors of Sample Nos. 16 to 19 have no problem in practical use, but according to detailed observation, marks of the film peeling were observed to such an extent that the film peeling does not affect the printing performance and the printing quality.

In addition, it is found from the results of Table 4 described above that, in the electrophotographic photoreceptors of Sample Nos. 29 to 32 where the surface roughness Sa of the outer chamfered face 22*b* is larger than the surface roughness Sa of the inner chamfered face 22*c* in the two-step chamfered face, abnormalities such as peeling or falling off of the film from the substrate end portion do not occur even during deposition of the surface layer, and defects in the outer circumferential surface (printed portion) of the electrophotographic photoreceptor 1C caused by the peeling or falling off, or image abnormalities or the like at the time of printing do not occur. In addition, the electrophotographic photoreceptors of Sample Nos. 25 to 28 have no problem in practical use, but according to detailed observation, marks of the film peeling were observed to such an extent that the film peeling does not affect the printing performance and the printing quality.

Furthermore, it is found from the results of Table 5 described above that, in the electrophotographic photoreceptors of Sample Nos. 34, 36, and 38 where the surface roughness Sa of the outer chamfered face 22*b* is larger than the surface roughness Sa of the substrate outer circumferential surface 22*a* and the surface roughness Sa of the inner chamfered face 22*c* is larger than the surface roughness Sa of the substrate outer circumferential surface 22*a* in the two-step chamfered face, abnormalities such as peeling or falling off of the film from the substrate end portion do not occur even during deposition of the surface layer, and defects in the outer circumferential surface (printed portion) of the electrophotographic photoreceptor 1C caused by the peeling or falling off, or image abnormalities or the like at the time of printing do not occur. In addition, the electrophotographic photoreceptors of Sample Nos. 33, 35, and 37 have no problem in practical use, but according to detailed observation, marks of the film peeling were observed to such an extent that the film peeling does not affect the printing performance and the printing quality.

In addition, the invention is not limited to only the ones illustrated in the above-described embodiments, and improvements and changes can be made without departing from the scope of the invention.

For example, in the above-described embodiments, the cylindrical substrate 10, the charge injection blocking layer 11*a*, and the photoconductive layer 11*b* are described as separate components, but alternatively, at least the surface of the cylindrical substrate 10 may be allowed to have a charge injection blocking characteristic. Accordingly, the cylindrical substrate 10 itself can have a function of blocking injection of carriers (electrons) from the cylindrical substrate 10 to the photoconductive layer 11*b* without separately providing the charge injection blocking layer 11*a*.

REFERENCE SIGNS LIST

1: Electrophotographic photoreceptor
1A to 1C: Electrophotographic photoreceptor
2: Plasma CVD apparatus
3: Support
4: Vacuum reaction chamber
5: Rotating means
6: Raw material gas supply means
7: Exhaust means
10: Cylindrical substrate
  10*a*: Substrate outer circumferential surface
  10*b*: Substrate end face
11: Photosensitive layer
  11*a*: Charge injection blocking layer
  11*b*: Photoconductive layer
12: Surface protective layer
13: Surface layer
20: Electrophotographic photoreceptor
  20*a*: Substrate outer circumferential surface
  20*b*: Chamfered face (C-face)
  20*c*: Substrate end face
21: Electrophotographic photoreceptor
  21*a*: Substrate outer circumferential surface
  21*b*: Chamfered face (R-face)
  21*c*: Substrate end face
22: Electrophotographic photoreceptor
  22*a*: Substrate outer circumferential surface
  22*b*: Outer chamfered face
  22*c*: Inner chamfered face
  22*d*: Substrate end face
30: Flange portion
31: Conductive support column
32: Insulating material
33: Guide plate
34: DC power supply
35: Control unit
36: Ceramic pipe
37: Heater
38: Dummy substrate
38A: Lower dummy substrate
38B: Intermediate dummy substrate
38C: Upper dummy substrate
40: Cylindrical electrode
41, 42: Plate
43, 44: Insulating member
42A, 44A: Gas outlet
45*a*, 45*b*: Gas inlet
46: Gas blow-off hole
49: Pressure gauge
50: Rotation motor
51: Rotational force transmission mechanism
52: Rotation introducing terminal
53: Insulating shaft member
54: Insulating flat plate
60 to 63: Raw material gas tank
64: Dopant-dedicated gas tank
  60A to 64A, 65*a*, 65*b*: Pipe
  60B to 64B, 60C to 64C: Valve
  60D to 64D: Mass flow controller
71: Mechanical booster pump
72: Rotary pump
100: Image forming apparatus
111: Charging device
112: Exposure device
113: Developing device
  113A: Magnetic roller
  113C: Toner transporting screw
114: Transfer device
  114A: Transfer charger
  114B: Separation charger
115: Fixing device
  115A, 115B: Fixing roller
116: Cleaning device
  116A: Cleaning blade
  116B: Cleaning roller
  116C: Toner transporting screw for discharge
117: Static eliminating device
P: Recording medium
T: Developer (toner)
U: First uneven portion
V: Second uneven portion
W: Third uneven portion

The invention claimed is:

1. An electrophotographic photoreceptor, comprising:
a cylindrical substrate comprising
  an outer circumferential surface comprising a first uneven portion,
  an end face, and
  a chamfered face located between the outer circumferential surface and the end face, the chamfered face comprising a second uneven portion, and a third uneven portion located on a surface of the second uneven portion; and
a surface layer located on the outer circumferential surface;
wherein a surface roughness Sa of the second uneven portion is larger than a surface roughness Sa of the third uneven portion.

2. The electrophotographic photoreceptor according to claim 1, wherein
a surface roughness Sa of the first uneven portion is 50 nm or more and 140 nm or less,
the surface roughness Sa of the second uneven portion is 180 nm or more and 1000 nm or less, and the surface roughness Sa of the third uneven portion is 90 nm or more and 140 nm or less.

3. The electrophotographic photoreceptor according to claim 1, wherein the surface layer comprises a charge injection blocking layer, a photoconductive layer, and a surface protective layer.

4. The electrophotographic photoreceptor according to claim 1, wherein the surface layer comprises amorphous silicon (a-Si).

5. The electrophotographic photoreceptor according to claim 1, wherein the surface layer comprises an organic material.

6. An image forming apparatus, comprising:

the electrophotographic photoreceptor according to claim 1; and a peripheral member capable of contacting the electrophotographic photoreceptor.

7. An electrophotographic photoreceptor, comprising:

a cylindrical substrate comprising an outer circumferential surface, an end face, an outer chamfered face located between the outer circumferential surface and the end face, the outer chamfered face being continuous with the outer circumferential surface, and an inner chamfered face located between the outer chamfered face and the end face; and a surface layer located on the outer circumferential surface;

wherein a surface roughness Sa of the outer chamfered face is larger than a surface roughness Sa of the inner chamfered face.

8. The electrophotographic photoreceptor according to claim 7, wherein the inner chamfered face is continuous with the outer chamfered face.

9. The electrophotographic photoreceptor according to claim 3, wherein the surface roughness Sa of the outer chamfered face is 90 nm or more and 140 nm or less, and the surface roughness Sa of the inner chamfered face is 10 nm or more and 80 nm or less.

10. The electrophotographic photoreceptor according to claim 7, wherein the surface layer comprises a charge injection blocking layer, a photoconductive layer, and a surface protective layer.

11. The electrophotographic photoreceptor according to claim 7, wherein the surface layer comprises amorphous silicon (a-Si).

12. The electrophotographic photoreceptor according to claim 7, wherein the surface layer comprises an organic material.

13. An image forming apparatus, comprising:

the electrophotographic photoreceptor according to claim 7; and a peripheral member capable of contacting the electrophotographic photoreceptor.

14. An electrophotographic photoreceptor comprising:

a cylindrical substrate comprising an outer circumferential surface, an end face, an outer chamfered face located between the outer circumferential surface and the end face, the outer chamfered face being continuous with the outer circumferential surface, and an inner chamfered face located between the outer chamfered face and the end face; and a surface layer located on the outer circumferential surface;

wherein a surface roughness Sa of the outer chamfered face is larger than a surface roughness Sa of the outer circumferential surface, and a surface roughness Sa of the inner chamfered face is larger than the surface roughness Sa of the outer circumferential surface, wherein the surface roughness Sa of the outer circumferential surface is 1 nm or more and 140 nm or less, the surface roughness Sa of the outer chamfered face is 180 nm or more and 1000 nm or less, and the surface roughness Sa of the inner chamfered face is 180 nm or more and 1000 nm or less.

15. The electrophotographic photoreceptor according to claim 14, wherein the inner chamfered face is continuous with the outer chamfered face.

16. The electrophotographic photoreceptor according to claim 14, wherein the surface layer comprises a charge injection blocking layer, a photoconductive layer, and a surface protective layer.

17. The electrophotographic photoreceptor according to claim 14, wherein the surface layer comprises amorphous silicon (a-Si).

18. The electrophotographic photoreceptor according to claim 14, wherein the surface layer comprises an organic material.

19. An image forming apparatus, comprising:

the electrophotographic photoreceptor according to claim 14; and a peripheral member capable of contacting the electrophotographic photoreceptor.

* * * * *